United States Patent [19]

Jackson

[11] 4,128,231

[45] Dec. 5, 1978

[54] INDIRECTLY FIRED VERTICAL SHAFT FURNACE

[76] Inventor: Denis H. Jackson, 850 W. Osborn Rd., Phoenix, Ariz. 85013

[21] Appl. No.: 884,928

[22] Filed: Mar. 9, 1978

[51] Int. Cl.[2] ..... C22B 43/00; F27B 1/00

[52] U.S. Cl. ..... 266/154; 266/159

[58] Field of Search ..... 75/62, 66, 69–71, 75/81, 86, 88, 91; 266/154, 159, 197–199, 144; 432/66, 200, 201, 202

[56] References Cited

U.S. PATENT DOCUMENTS

| | | | |
|---|---|---|---|
| 1,213,347 | 1/1917 | Fink | 266/154 |
| 2,809,026 | 10/1957 | Bagley | 432/200 |
| 3,876,189 | 4/1975 | Jackson et al. | 266/159 |

*Primary Examiner*—Gerald A. Dost

*Attorney, Agent, or Firm*—Sughrue, Rothwell, Mion, Zinn and Macpeak

[57] ABSTRACT

An indirectly fired vertical shaft furnace suitable for use as a volatilizing furnace for recovering metals from their ores, a crop drying or roasting furnace or a heating furnace is comprised of two concentric cylindrical metal shells each of which is closed at the upper end. The outer shell is completely lined with a lightweight insulating material and the lower end of the shell is connected to the upper end of an annular fire chamber having an upwardly open U-shaped cross-section cast from firebrick material. Two tangentially directed burners extend into the chamber to produce a swirling action of the hot gases in the heating chamber between the two cylindrical members. Conduits are provided through the top walls of both cylindrical member for withdrawing the material from the bottom of the central chamber. A vapor collector is coaxially located within the central chamber and has spirally arranged apertures for collecting vapors under transverse channels extending radially outwardly from the conduit across the central chamber above each of the apertures. Additional conduits are provided at the bottom of the central chamber for introducing air into the central chamber and collector conduit and additional conduits are provided at the top of the central chamber for removing vapors from the central chamber and the collecting conduit.

4 Claims, 4 Drawing Figures

INDIRECTLY FIRED VERTICAL SHAFT FURNACE

BACKGROUND OF THE INVENTION

1. Field of the Invention

The present invention is directed to an indirectly fired vertical shaft furnace suitable for use as a volatilizing furnace for recovering metals from their ores, a drying or roasting furnace for crops or a hot air heating furnace.

2. Prior Art

The present invention is an improvement over the Jackson et al U.S. Pat. No. 3,876,189 directed to an automatic feedupright ore furnace. The furnace disclosed in this patent was provided with a cylindrical steel retort of a suitable fire resistant alloy but the outer heating chamber which completely surrounded the retort was constructed of firebrick. The lower portion of the cylindrical steel retort was also covered with a layer of firebrick to define an annular flame chamber and since the flame jet was directed radially inwardly through the outer wall, it was necessary to provide an upwardly angled flame shield for deflecting the heat upwardly into the annular heating chamber surrounding the steel retort. In the Jackson et al patent a metal vapor collector conduit was coaxially located within the retort and was provided with spirally arranged apertures for collecting metal vapor under transverse channels, which extended radially outwardly from the conduit above each of the apertures and which were supported underneath by substantially triangular gussets. Air was supplied to the lower end of the retort by two diametrically opposed conduits extending radially inwardly through the firebrick walls of the combustion chamber and the supply of air to the centrally located collector conduit was controlled by a damper at the lower end of the collector conduit which extended vertically downwardly through the bottom of the furnace.

Thus, the Jackson et al patent provided an improved metal volatilization furnace for extracting metal from an ore which was continuously tumbled downwardly through the furnace in a spiral path without the need of any moving parts within the furnace.

SUMMARY OF THE INVENTION

The present invention provides a new and improved indirectly fired vertical shaft furnace which is suitable not only for metal volatilization as taught by the Jackson et al patent but is also suitable for use as a drying or roasting furnace for crops and as a hot air furnace for heating building structures or for supplying hot air for any other purpose.

The present invention provides a new and improved indirectly fired vertical shaft furnace which is substantially lighter than the furnace disclosed in the Jackson et al patent due to an improved design of the combustion chamber and heating chamber which surround the cylindrical retort. The entire upper portion of the outer cylindrical shell is constructed of sheet steel lined with a highly efficient lightweight insulating material and the combustion chamber is formed as a precast unit of firebrick material having tangentially disposed burners therein thereby eliminating the necessity of thicker walls and a flame shield while providing a more efficient upwardly spiral flow of hot gases through the heating chamber.

The present invention provides a new and improved indirectly fired vertical shaft furnace wherein the inverted V-shaped vapor collecting channels extending outwardly from the central collecting conduit are supported by means of rods secured to and depending from the top wall of the retort. Such a support arrangement, as opposed to the triangular gusset plates in the Jackson et al patent, provides for an improved downward spiral motion of the material being heated in the retort and for an improved vapor collecting arrangement.

The present invention provides a new and improved indirectly fired vertical shaft furnace wherein the supply of air to the bottom of the retort and to the bottom of the collecting conduit is accomplished by means of a plurality of horizontally extending conduits located in a single housing which extends transversely across the bottom of the retort in spaced relation above the lower outlet for the retort and which is provided with a suitable contour to facilitate the flow of material thereabout. The location of all the air supply conduits within a single housing locates the control means for the air supply at a single convenient location.

The foregoing and other objects features and advantages of the invention will be apparent from the following more particular description of a preferred embodiment of the invention as illustrated in the accompanying drawings.

DETAILED DESCRIPTION OF THE INVENTION

Although the furnace according to the present invention can be used for crop drying or roasting as well as a furnace for the production of hot air, the primary use of the furnace is for the volatilization of many metals, semi-conductors and other elements from their ores. By way of example only, the furnace will be described in conjunction with the recovery of mercury from its ore.

Briefly, in accordance with the present invention, the furnace is provided with an elongated upright cylindrical retort chamber, means for introducing comminuted mercury ore into the upper end of the retort and for withdrawing mercury ore gangue from the bottom of the retort. A vertically disposed mercury vapor collector conduit is disposed coaxially within the retort and is provided with a plurality of apertures disposed in spiral paths along the length of the conduit and downwardly opening mercury vapor collector channels extending radially outwardly from the conduit transversely across the retort above each of the apertures for collecting the volatilized mercury and directing it through the apertures into the conduit.

Figure 1:
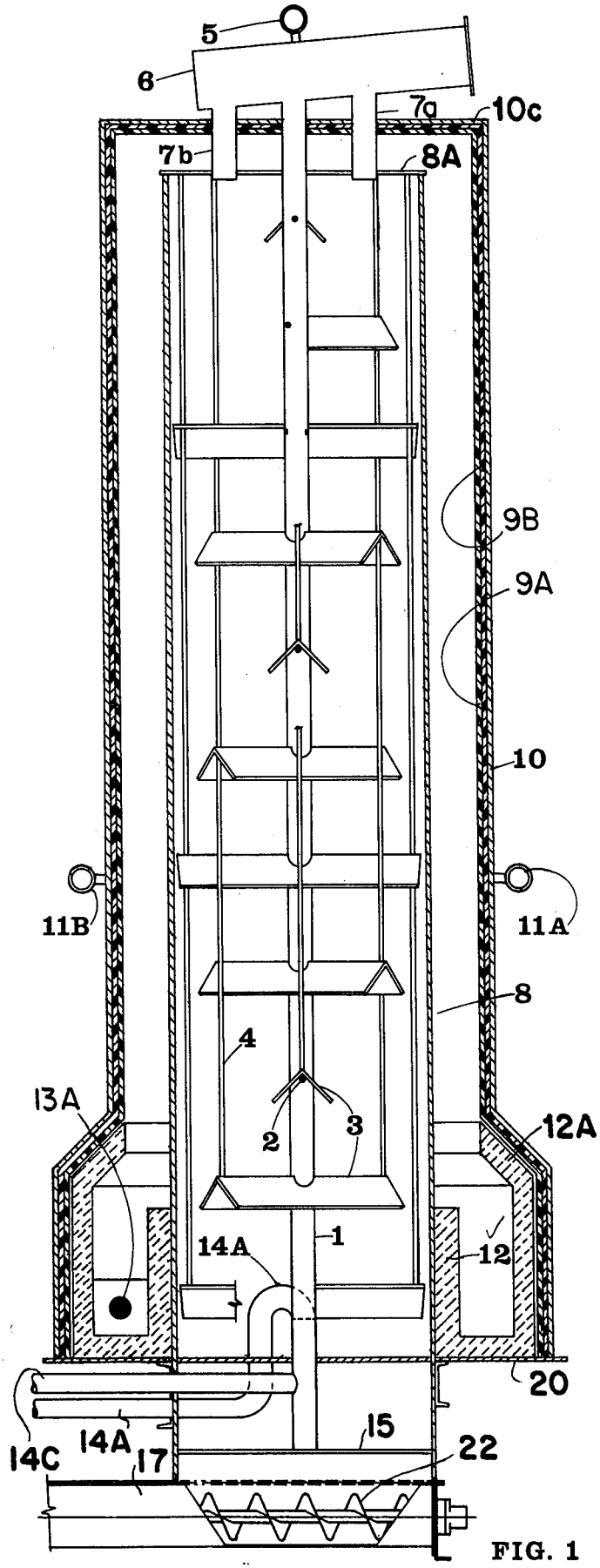
FIG. 1 is a partial cross-sectional view of the indirectly fired vertical shaft furnace embodying the present invention.
Figure 2:
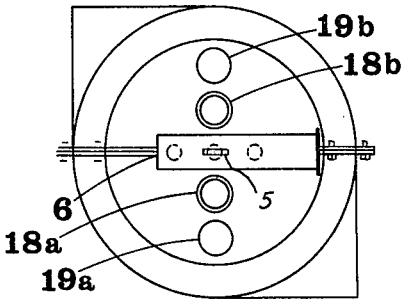
FIG. 2 is a top view of the furnace of FIG. 1.
Figure 3:
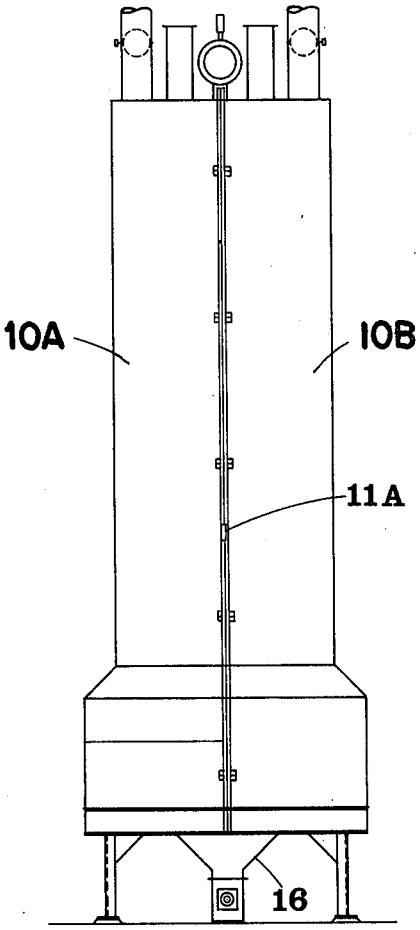
FIG. 3 is an exterior side elevation view of the furnace shown in FIG. 1.

Turning now to the drawings, FIG. 1 illustrates the indirectly fired vertical shaft furnace according to the present invention having a cylindrical retort of a suitable heat resistant steel alloy which, for example, could be $\frac{3}{8}$ inches to $\frac{1}{2}$ inches thick. The dimensions of the retort are not critical and will depend primarily on the desired capacity of the apparatus. For example, a retort 4' in diameter by 10' high with an 8' discharge screw for removing ore gangue will handle 50 tons of ¼ inches ground mercury ore per 24 hours. An outer cylindrical heat shield 10 is disposed in spaced concentric relation about the retort and may also be constructed from sheet steel. The top ends of the retort and the heat shield are both closed by top walls 8A and 10C of the same material from which the retort and heat shield are constructed respectively, and the entire inner surface of the heat shield is covered with two layers 9A and 9B of lightweight insulating material such as "Cerefelt" manufactured by Johns-Manville Company. To facilitate the original installation and replacement of the insulating material the entire heat shield assembly may be constructed in three pieces. Two half round side pieces 10A and 10B which extend from above the top 8A of the retort 8 down to the bottom end plate 20 on which they rest may be detachably connected to each other by any suitable means. The heat indicator gauges 11A and 11B may also be located between the two halves of the heat shield as shown in FIG. 2 to facilitate the replacement of the heat gauges if necessary. The two halves of the heat shield are each provided with flanges which are secured in abutting relation by any means such as nuts and bolts or the like. The top wall 10C of the heat shield may be integrally formed with each half of the side pieces or may be constructed as a round separate piece which is subsequently secured to the top of the cylindrical heat shield by any suitable means such as draw bolts, clamps or the like.

The combustion chamber 12 is cast in one piece from any suitable firebrick material but it is preferable to have the combustion chamber cast in several sections for ease of handling. The combustion chamber sits on the bottom plate 20 within the lower enlarged diameter portion of the heat shield 10. The combustion chamber 12 has a generally U-shaped configuration with the outer wall higher than the inner wall and in-turned at 12A to protect the bevelled connection portion of the outer heat shield 10. One or more burners such as the burner 13A shown in FIG. 1 are disclosed tangentially through the wall of the heat shield 10 and the combustion chamber 12 so that the jet of flame issuing from the burner will be directed circumferentially around the annular channel defined by the walls of the combustion chamber. Additional burners would also be oriented to direct the flame jets in the same direction to create a swirling mass of combustion gases which will rise upwardly in a spiral manner through the annualr heating chamber defined between the retort 10 and the insulated heat shield 10.

A vapor collector conduit 1 is disposed concentrically within the retort 8 and extends upwardly through the housing 15 in which it is supported, through the entire length of the retort 8 and through apertures in the top wall 8A of the retort and the top wall 10C of the heat shield. The vapor collector conduit 1 is very similar to the vapor collector conduit shown in the Jackson et al U.S. Pat. No. 3,876,189 inasmuch as it is provided with the plurality of pairs of apertures 2 which extend in a spiral fashion about the conduit. Vapor collecting shields 3 which are comprised of inverted angle irons are mounted on the conduit 1 immediately above the apertures 2 and extend transversely substantially the entire diameter of the retort 8. In that above mentioned patent the vapor collectors 3 were supported by means of a substantially triangular shaped gusset which was secured to the conduit 1 at one side and to the apex of the collector along the top edge. According to the present invention the outer ends of the vapor collectors 3 are supported by means of rods 4 which extend downwardly from and are secured to the top wall 8A of the retort. The presence of the gussets in the aforementioned patent tended to interfer with the spiral flow of the material as it passed downwardly through the retort and also intended to interfer with the collection of the vapor beneath the inverted V-shaped channel members 3. The use of the rods 4 according to the present invention do not present any significant obstruction to the downward spiral flow of the material and the inverted V-shaped channels are completely open to allow a more efficient collection of vapors which are then directed through the apertures 2 into the vapor collector conduit 1.

Figure 4:
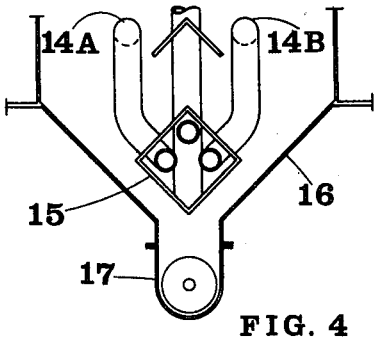
FIG. 4 is a partial sectional view through the conduit housing and feed screw at the bottom of FIG. 1.

Fresh air is supplied to the furnace through three conduits 14A, 14B and 14C as best seen in FIGS. 1 and 4. The three conduits are located within a housing 15 having a substantially square-shaped cross-sectional configuration which is oriented to facilitate the downward flow of the material in the retort. The housing 15 is spaced from the lower alls 16 of the retort to allow for the flow of material therebetween into the hopper 17 in which a feed screw 22 is mounted. The feed screw 22 may be driven by any suitable means (not shown) to remove the material as it exits from the bottom of the retort 8. The housing 15 extends diametrically across and is secured to the inner walls of the retort 8. The inlet ends of the three conduits 14A-C may be provided with any suitable valve means to control the supply of fresh air to the retort. Air pumps may be provided to supply the air through the conduit under pressure. The conduit 14C is connected directly into the vertical conduit 1 so that the flow of air upwardly through the conduit 1 will tend to draw the vapors collected under the inverted V-shaped collectors 3 inwardly through the apertures 2. The conduits 14A and 14B open downwardly as best seen in FIG. 1 to prevent the entry of material therein which might clog the conduit and the air under pressure delivered through these conduits then rises upwardly counter to the downward flow of material through the retort 8. The air and collected vapors from the conduit 1 pass upwardly into a main manifold 6. Conduits 7a and 7b are also connected to the manifold 6 and extend downwardly through the tops of the heat shield and the retort so as to collect the remaining vapors which rise upwardly along with the flow of air through the mass of material. All of the collected vapors are then directed by any suitable piping from the manifold 6 to suitable separating and collecting means. A thermal couple control gauge 5 is provided in the manifold 6 for sensing the temperature of the collected vapors and this information along with the information received from the heat gauges 11A and 11B provide the necessary control on the parameters for the burner unit 13A. The control circuitry integrating the heat gauges and the burner need not shown since it is not considered part of the present invention and could readily be supplied by one skilled in the art. The material to be subjected to the heat treatment within the retort is supplied to the retort through the pipes 18a and 18b which extend downwardly through the top walls of the heat shield and retort. These conduits may be connected to any suitable supply means for a gravity feed of the material into the retort. Also, extending through the top 10C of the heat shield are exhaust conduits 19a and 19b which remove the combustion gases from the space between the retort and the heat shield.

For extremely long life and greater efficiency of the furnace the retort 8, the conduit 1, the inverted V-shaped vapor collectors 3 and the support rods 8 may be made of stainless steel. Type #304 stainless steel is utilized in these areas for a heat range up to approximately 1400° F. For larger size industrial furnaces operating above 1400° F but not exceeding 2000° F, Inconel nickle alloy which has a heat range up to approximately 2500° F should be utilized.

The operation of the furnace is substantially identical to that of the furnace disclosed in the aforementioned patent for the vaporization of metals, semiconductors and the like. However, the present furnace provides a far greater degree of efficiency and utilize a much lighter weight construction than that disclosed in the previous patent. Furthermore, the furnace according to the present invention is also suitable for the drying or roasting of certain crops and may also be used as a hot air heater in certain instances.

While the invention has been particularly shown and described with reference to a preferred embodiment thereof it will be understood by those in the art that various changes in form and details may be made therein without departing from the spirit and scope of the invention.

What is claimed:

1. An indirectly fired vertical shaft furnace comprising an elongated upright cylindrical retort, annular combustion chamber means surrounding the lower end of said retort, at least one burner tangentially located in said annular combustion chamber for directing a flame substantially horizontally into said annular combustion chamber in a circumferential direction, cylindrical heat shield means disposed in spaced concentric relation outwardly of said retort and said combustion chamber, said retort and said heat shield each having cover means spaced from each other to define a heating chamber which substantially surrounds the entire length of the retort and the top of the retort to provide a uniform heating of the retort, means for supplying material through the top walls of said heat shield and retort into said retort, means for withdrawing material from the bottom of said retort and vapor collector means comprising a stationary vertical vapor collector conduit disposed concentrically within said cylindrical retort and having a plurality of spirally arranged apertures therein, downwardly opening concave vapor collector channels rigidly connected to said collector conduit above each of said apertures and extending radially outwardly toward said retort for collecting rising vapors and directing said vapors through said apertures to the interior of said conduit, means for withdrawing said vapors from the upper end of said conduit and rod means secured to the top wall of said retort and the outer ends of said collector channels to support said channels against the weight of the downwardly moving material.

2. An indirectly fired vertical shaft furnace as set forth in claim 1 wherein said annular combustion chamber is comprised of an upwardly opening U-shaped channel of firebrick material having an annular inwardly extending deflector portion integral with the outermost wall above the top of the other wall of the U-shaped channel to direct the combustion gases toward the exterior circumference of the retort about which the annular combustion chamber extends.

3. An indirectly fired vertical shaft furnace as set forth in claim 2 wherein said heat shield means is comprised of two semi-cylindrical portions formed of sheet steel, means connecting said semi-cylindrical portions together to form a cylindrical heat shield around said retort and combustion chamber means and at least one layer of lightweight insulating material secured to the internal surface of said heat shield means.

4. An indirectly fired vertical shaft furnace as set forth in claim 1 further comprising air supply means, housing means secured within said retort diametrically thereof adjacent the bottom of said retort for supporting said collector conduit, said air supply means including conduit means extending into said housing means with one of said conduit means disposed in communication with the interior of said collector conduit and other conduit means extending outwardly of said housing for supplying air to the interior of said retort.

* * * * *